United States Patent [19]

Kern et al.

[11] Patent Number: 4,460,317

[45] Date of Patent: Jul. 17, 1984

[54] ION PUMP

[75] Inventors: Robert H. Kern; Wilfred P. Levesque, both of Danvers, Mass.

[73] Assignee: Kernco, Inc., Danvers, Mass.

[21] Appl. No.: 330,326

[22] Filed: Dec. 14, 1981

[51] Int. Cl.[3] ..... F04B 37/02

[52] U.S. Cl. ..... 417/49

[58] Field of Search ..... 417/49, 48, 63; 313/7, 313/237, 158

[56] References Cited

U.S. PATENT DOCUMENTS

| | | | |
|---|---|---|---|
| 2,114,339 | 4/1938 | Espe | 313/158 |
| 3,228,590 | 1/1966 | Kearns et al. | 417/49 |
| 3,249,291 | 5/1966 | Ackley | 417/49 |
| 3,319,875 | 5/1967 | Jepsen | 417/49 |
| 3,371,853 | 3/1968 | Maliakal | 417/49 |
| 3,994,625 | 11/1976 | Welch | 417/49 |

*Primary Examiner*—Edward K. Look

[57] ABSTRACT

An ion pump is described which includes a vacuum housing, a unique, readily removable and replaceable magnet system which makes it possible to measure leakage current alone and a unique, readily removable and replaceable reactive metal cathode for reacting with gaseous ions impinging thereon for their collection. It also includes a novel tandem sputter shielding arrangement for preventing deposition of sputter products on the anode insulator. Both power supply and current metering means which may be mounted on and directly connected to the ion pump are also described.

29 Claims, 5 Drawing Figures

FIG 1
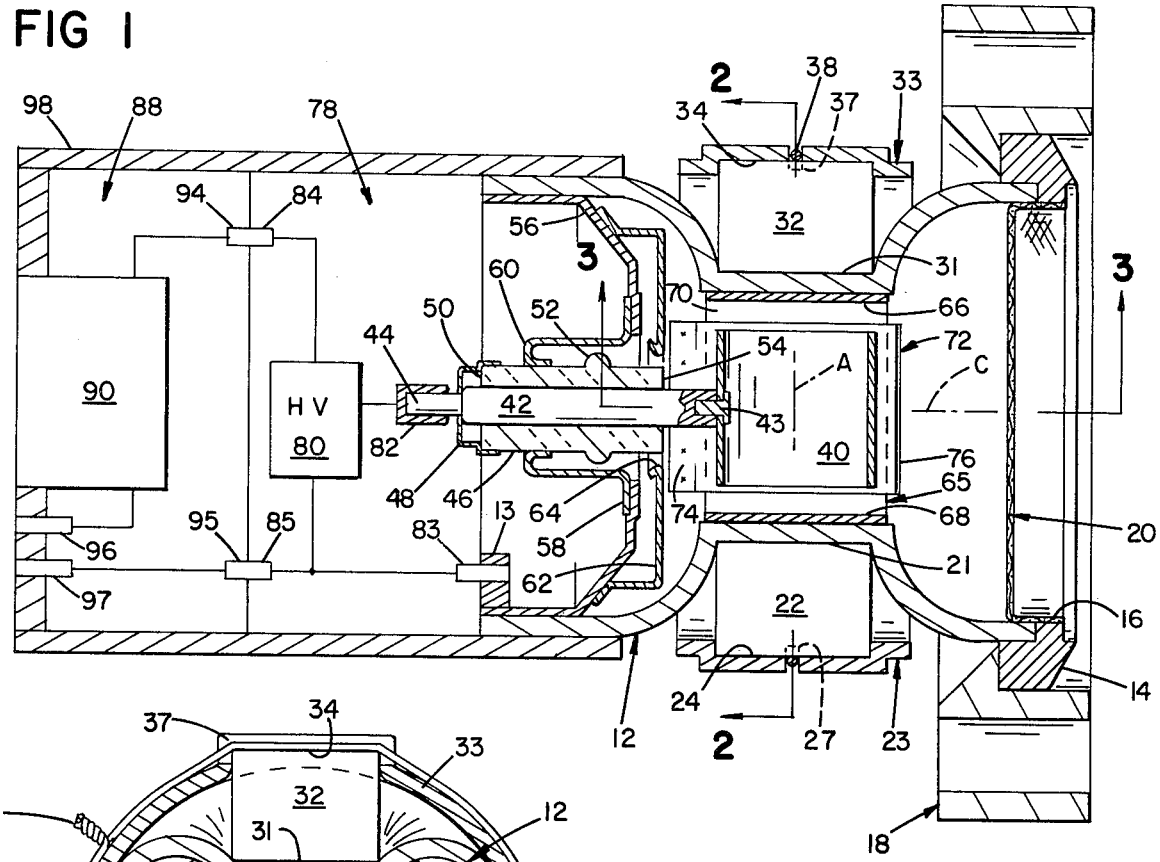
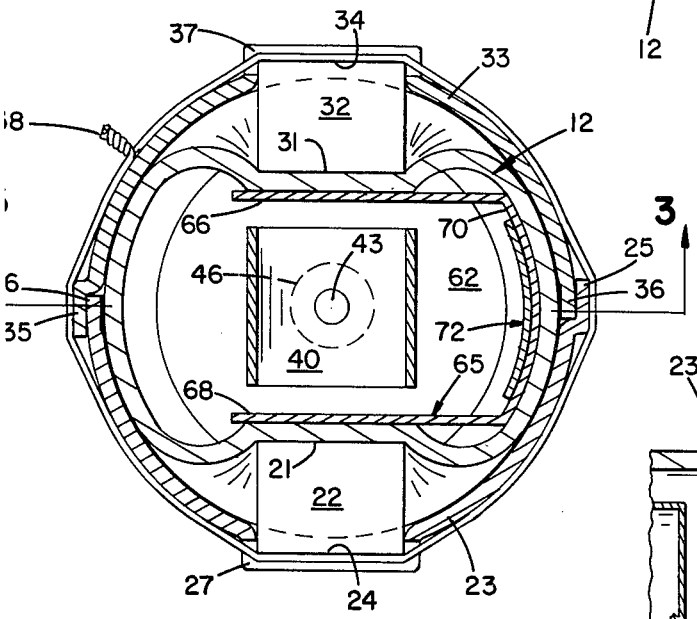
FIG 2
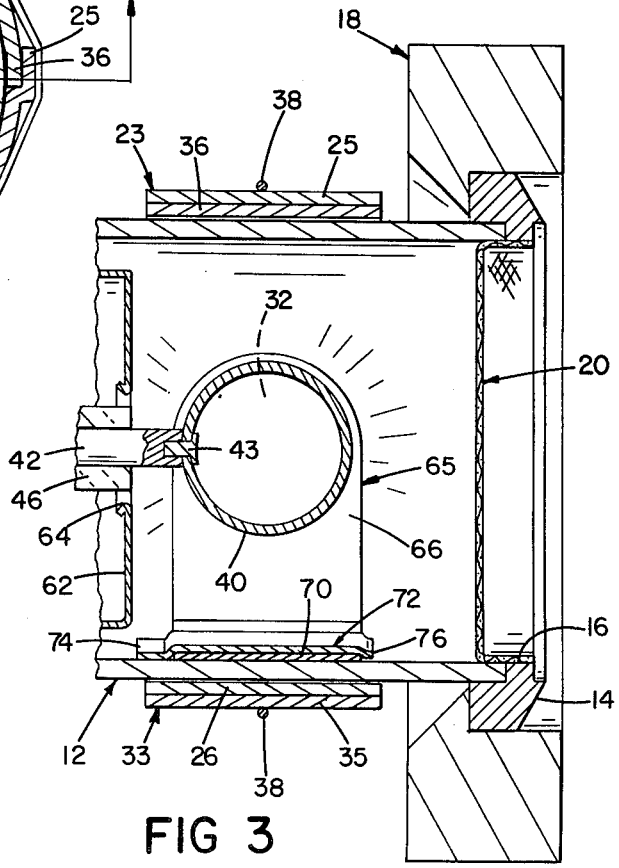
FIG 3

FIG 4
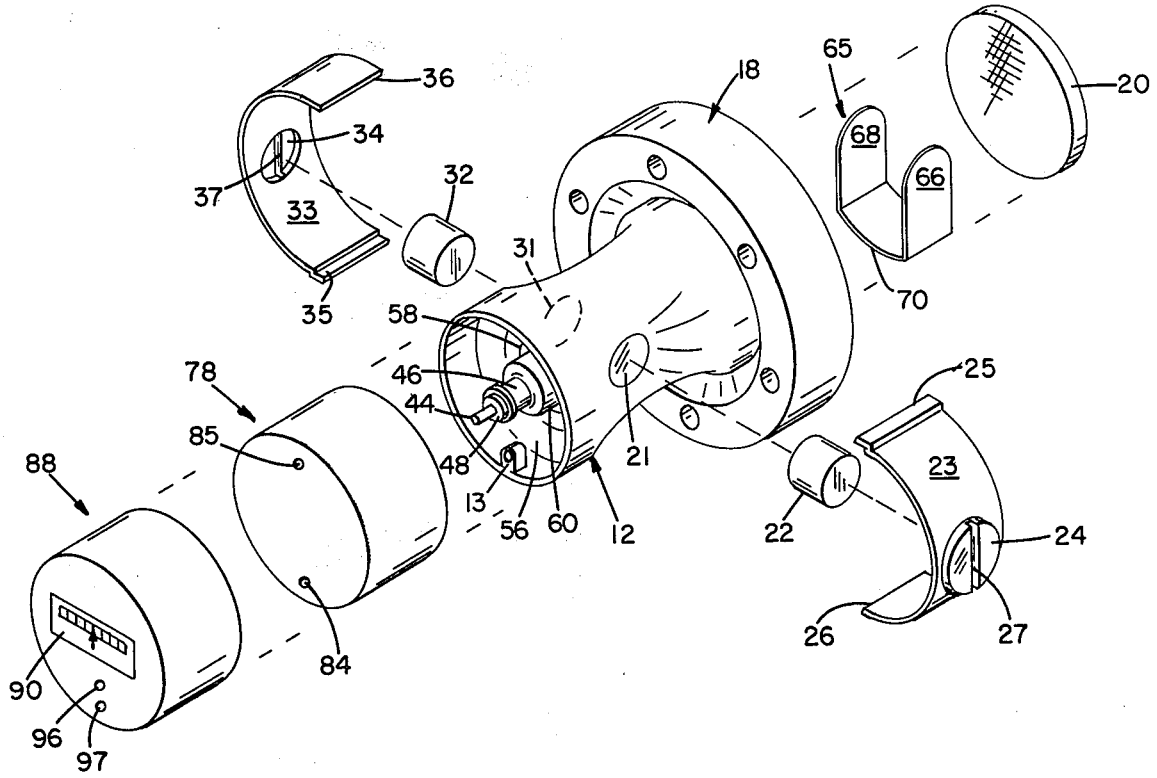
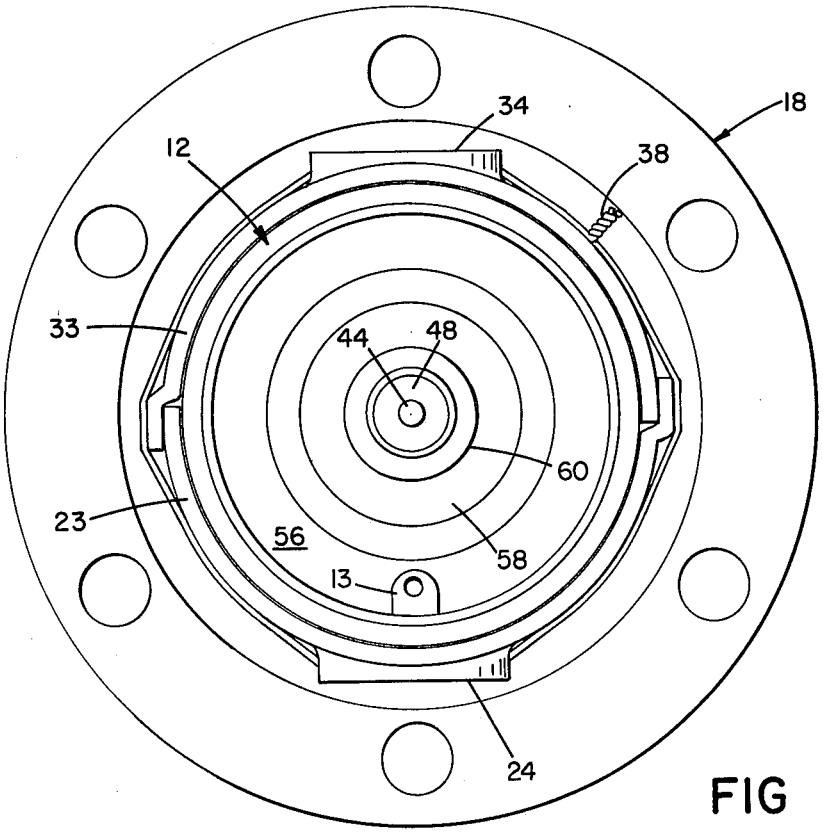
FIG 5

ION PUMP

This invention relates to improvements in ion pumps.

Ion pumps, including a vacuum housing, a magnet system providing a magnetic field, an anode positioned in the magnetic field and a reactive metal cathode positioned between the anode and the magnet system for reacting with gaseous ions impinging thereon for their collection, are well known in the art. Such known pumps, however, are subject to a number of deficiencies.

For example, the reactive metal cathode, because of its reaction with the gaseous ions, in time has its efficiency reduced to the extent that it must be replaced, as determined by the measurement of pressure-related current, that is, the ion current flowing between anode and cathode. This requires a substantial disassembly and reconstruction of the pump.

Another problem arises because the deposition of sputter products on the ceramic high voltage anode insulator in time increases the leakage current to the extent that the insulation must be replaced or the sputter products removed. Again, this requires a substantial disassembly and reconstruction of the pump.

Another problem with known ion pumps involves the difficulty of measurement of their leakage current independently of their pressure-related current, so that their operating efficiency cannot readily be determined.

Still another problem arises because of the necessity of providing known ion pumps with separate high voltage power supply and current metering systems.

In addition, the construction of known ion pumps is both unduly complicated and expensive.

Accordingly, it is a major object of the invention to provide a novel ion pump not subject to any of the above mentioned problems and one which provides a simpler and more economical construction.

These objects are accomplished according to the present invention by providing a novel ion pump having a number of unique features.

In one aspect, the present invention provides novel cathode mounting means for removably mounting the cathode for removal and replacement without the necessity for dissassembly and reassembly of the ion pump.

In another aspect, the present invention provides novel sputter shielding for preventing deposition of sputter products on the outer surface of the anode insulator.

In still another aspect, the present invention provides a novel magnet system which makes it possible to measure leakage current alone simply by removing the system from the pump. The system, furthermore, is not only so simple as to be readily removable and replaceable, but also provides a closed magnetic loop for improved efficiency.

In a further aspect, the invention provides both power supply and current metering means which may be mounted on and directly connected to the ion pump of the invention.

For the purpose of fully describing the above and further objects and features of the invention, reference is now made to the following detailed description of a preferred embodiment thereof, taken together with the accompanying drawings, wherein:

FIG. 1 is a side sectional view of the ion pump of the invention;

FIG. 2 is a sectional view of the ion pump of FIG. 1 taken on line 2—2 thereof;

FIG. 3 is a sectional view of the ion pump of FIG. 1 taken on lines 3—3 of FIGS. 1 and 2;

FIG. 4 is a sectional view of the ion pump of FIG. 1 taken on line 4—4 thereof; and FIG. 5 is a disassembled perspective view of the ion pump of FIG. 1.

Referring to the drawings, the ion pump of the present invention includes a generally circular, tubular housing 12 having a central axis C with a gas input opening 16 at one end and an axially extending high voltage power input terminal 44 at its opposite end. A sealing flange 14 and associated mounting ring 18 is provided on the end of housing 12 around its gas input opening 16. Other known mounting arrangements may also be used. A filter screen 20 is removably mounted by a press fit within gas input opening 16.

Externally on housing 12 is mounted a readily assembled magnet system, including a pair of identical, opposed removable ferrous metal magnet yokes 23, 33, each extending around about one half the periphery of housing 12 to together surround housing 12, and a pair of identical, opposed cylindrical magnets 22, 32, each positioned and removably retained between one of yokes 23, 33 and the exterior surface of housing 12, with their axes located on transverse axis A perpendicular to and passing through housing central axis C, to provide the necessary magnetic field therebetween. Housing 12 includes a pair of opposed recesses 21, 31 and yokes 23, 33 each include a recess 24, 34, respectively, for positioning and retaining magnets 22, 32, respectively, therebetween. Yokes 23, 33 are identical and extend around housing 12 for slightly in excess of 180 degrees, yokes 23, 33 each having a concentric outwardly offset end 25, 35, respectively, which overlies their other ends 26, 36, respectively, to provide a closed magnetic loop around housing 12. Although magnets 22, 32 and their yokes 23, 33 are normally retained in position by magnetic forces, they may be positively secured by a temporary securing wire 38 passing therearound through slots 27, 37 in the exterior surface of yoke recesses 24, 34. By removing securing wire 38, yokes 23, 33 and magnets 22, 32 may be readily removed from housing 12, since they are not positively secured thereon except by temporary securing wire 38, in order to make possible the measurement of leakage current independently of pressure-related current, since removal of the magnets 22, 32 eliminates pressure-related current flow, as is well known in the ion pump art.

A high voltage conductor 42 extends along housing central axis C from external high voltage terminal 44 and has mounted on its free end, by eyelet 43, a conventional hollow cylindrical anode 40 having its axis coincident with magnet axis A and with its ends spaced from the interior surfaces of housing magnet recesses 21, 31, in the magnetic field between magnets 22, 32, for ionizing gaseous atoms in the usual manner. Conductor 42 has a surrounding ceramic insulating sleeve 46 having its free end 54 spaced from anode 40 and having its terminal end 50 sealingly connected, at its input terminal 44 by mounting ring 48 to sleeve 46. Sleeve 46 is itself sealingly mounted at its terminal end 50 adjacent the input terminal end of housing 12 by an outer mounting cup 56 mounted within in housing 12 and an inner mounting cup 58 mounted on outer mounting cup 56 and insulating sleeve 46. Inner mounting cup 58 has a retroverted portion 60, concentric with the outer surface of sleeve 46, which cooperates with surrounding sleeve protuberance 52, from which it is slightly spaced outwardly, to prevent passage of sputter products onto the outer surface of insulating sleeve 46 in its portion between protuberance 52 and the edge of inner mounting cup 58 mounted on insulating sleeve 46.

For preventing the deposition of sputter products on the outer peripheral surface of insulating sleeve 46 between its free end 54 and protuberance 52, a novel circular sputter shield 62 is provided. Sputter shield 62 has its outer edge mounted on outer cup 56 and its inner inner edge 64 closely spaced, about 0.025 inches, from and extending outwardly from the free end 54 of insulating sleeve 46 spaced from and adjacent to anode 40. The novel tandem configuration of the two sputter shielding gaps provides exponential sputter shielding attenuation.

A novel reactive metal cathode, preferably of high purity titanium and generally designated 65, is removably mounted within housing 12 between and spaced from the ends of anode 40 and in contact with the inner surface of housing magnet recesses 21, 31 for reacting with gasous ions impinging thereon to collect said ions by chemical reaction, as is well known in the ion pump art. More specifically, the novel removable cathode 65 according to the present invention comprises a "U" shaped sheet metal member having a base portion 70 and leg portions 66,68, with its base portion 70 frictionally retained between spring clip 72, which has its inner end secured within housing 12 and its free end 76 generally parallel to the inner surface of housing 12 and facing opening 16, and the inner surface of housing 12, so that leg portions 66, 68 are located between each of magnets 22, 32 and anode 40. With this arrangement, cathode 65 is securely retained within housing 12 in proper low resistance electrical contact therewith, yet may be easily removed, after first removing filter screen 20, and replaced through opening 16, after which filter screen 20 may be replaced.

Further in accordance with the present invention, a high voltage power supply unit 78, including a conventional solid state high voltage power supply 80, having low voltage input terminals 84, 85 on one end and a high voltage output terminal 82 on its opposite end may be mounted by surrounding mounting sleeve 98 on the power input terminal end of housing 12 with its high voltage output terminal 82 connected directly to high voltage input terminal 44 and its ground terminal 83 connected directly to housing ground terminal 13 of the ion pump.

There may also be provided a current metering unit 88 having low voltage input terminals 84, 85 and low voltage output terminals 94, 95 with a conventional microammeter 90 connected therebetween, current metering unit 88 being mounted by mounting sleeve 98 on the low voltage input terminal end of power supply unit 78, with its low voltage output terminals 94, 95 connected directly to low voltage input terminals 84, 85 of power unit 78. Microammeter 90 may be provided with a logarithmic scale to provide a direct pressure reading, as is well known in the ion pump art.

In operation, with metering unit 88 connected to a suitable low voltage power source and with power unit providing a suitable high voltage to anode 40, gaseous atoms passing into housing opening 16 are removed in the usual manner by converting or implanting them into reactive metal solid products on the surface of cathode 65. As is well known, such conversion degrades the cathode surface, so that cathode 65 must be replaced in time. However, the novel replaceable cathode 65 of the invention makes it possible to do this in the field, without significant disassembly of the ion pump, as has been explained above.

The ion conversion also produces sputter products, which, if deposited on the surface of ceramic insulating sleeve 46, provide a current leakage path and a resulting resistive leakage current which in time reduces the efficiency of the pump to a sufficient degree that it must be replaced or repaired. The narrow gap between the free end of the ceramic insulating sleeve 46 and the inner edge 64 of sputter shield 62 of the present invention, particularly in tandem arrangement with the narrow gap between insulating sleeve protuberance 52 and the surrounding retroverted portion 60 of inner sleeve mounting cup 58, as explained above, essentially prevents significant deposition of sputter products on the surface of insulating sleeve 46, so that the resistive leakage current is insignificant.

In this regard the novel removable magnet system of the invention makes it possible to directly measure any resistive leakage current in the field, by simply removing the magnet system, also as explained above. The true pressure-related current can then be determined by subtracting the measured leakage current from the measured total current.

Finally, the pump mounted high voltage and current measuring units of the invention provide not only a simplified, but also a safer arrangement, as well as one which can be readily operated by an emergency power supply, such as a battery.

Various modifications of the inventions herein described, within the spirit thereof and the scope of the appended claims, will occur to those skilled in the ion pump art.

What is claimed is:

1. In an ion pump including a pump housing magnet means providing a magnetic field within said housing anode means positioned in said housing and said field, and cathode means in said housing positioned between said anode means and said magnet means for collecting ions impinging thereon, that improvement comprising cathode mounting means removably, frictionally and independently mounting said cathode means for removal and replacement thereof.

2. In an ion pump as claimed in claim 1, wherein said cathode mounting means includes spring clip means for frictionally mounting said cathode means.

3. In an ion pump including magnet means having opposed pole pieces providing a magnetic field anode means positioned between said pole pieces in said field, and reactive metal cathode means positioned between said anode means and said pole pieces for reacting with gaseous ions impinging thereon to collect said ions, that improvement comprising cathode mounting means removably mounting said cathode means for removal and replacement thereof, said cathode mounting means including spring clip means for frictionally mounting said cathode means, and wherein said cathode means comprises a "U" shaped sheet metal member having a base portion frictionally retained by said spring clip means and leg portions located between each of said pole pieces and said anode.

4. An ion pump including a generally tubular pump housing having an opening magnet means mounted on said housing providing a magnetic field therewithin anode means mounted within said housing in said magnetic field cathode means mounted within said housing between said anode means and said magnet means for collecting ions impinging thereon, and cathode mounting means within said housing removably, frictionally and independently mounting said cathode means for removal and replacement thereof through said opening.

5. An ion pump including a generally tubular housing having an opening magnet means mounted on said housing providing a magnetic field anode means mounted within said housing in said magnetic field reactive metal cathode means mounted within said housing between said anode means and said magnet means for reacting with gaseous ions impinging thereon to collect said ions, and cathode mounting means within said housing removably frictionally mounting said cathode means for removal and replacement thereof through said opening, said cathode mounting means including spring clip means mounted in said housing with its free end generally parallel to the inner surface of said housing for frictionally mounting said cathode means, and said cathode means comprising a "U" shaped sheet metal member having a base portion and leg portions with said base portion frictionally retained between said spring clip and the inner surface of said housing and its leg portions located between said magnet means and said anode.

6. An ion pump including a generally tubular housing magnet means including a pair of opposed magnet yokes each extending around about one half the periphery of said housing to together surround said housing, and a pair of opposed magnets each retained between one of said yokes and the exterior surface of said housing providing a magnetic field therebetween anode means mounted within said housing between said magnet means, and reactive metal cathode means mounted within said housing between said anode means and said magnet means for reacting with gaseous ions impinging thereon to collect said ions.

7. An ion pump as claimed in claim 6, wherein said magnet yokes overlap at their opposite ends to provide a closed magnetic loop.

8. An ion pump including a housing having a high voltage power input terminal magnet means providing a magnetic field within said housing high voltage conductor means in said housing connected at one end to and extending from said terminal and having a surrounding insulating sleeve anode means in said housing connected to the end of said conductor means opposite from its terminal end, said anode means being spaced from said insulating sleeve and being positioned in said magnetic field, and cathode means in said housing positioned between said anode means and said magnet means for collecting ions impinging thereon, and sputter shielding means surrounding and being substantially coaxially closely spaced from the end of said insulating sleeve opposite its terminal end and extending outwardly therefrom for preventing deposition of sputter products on said insulating sleeve.

9. An ion pump including a generally tubular housing having a central axis with a gas input opening at one end and an axially extending high voltage power input terminal at its opposite end magnet means mounted externally on said housing providing a magnetic field high voltage conductor means having a surrounding insulating sleeve sealingly mounted at the input terminal end of said housing by a mounting cup mounted within in said housing anode means mounted on the end of said conductor means spaced from said insulating sleeve and between said magnets reactive metal cathode means mounted within said housing between anode means and said magnets for reacting with gaseous ions impinging thereon to collect said ions, and sputter shielding means closely spaced from and extending outwardly from the end of said insulating sleeve adjacent said anode means and cathode means for preventing deposition of sputter products on the outer peripheral surface of said insulating sleeve.

10. An ion pump system including an ion pump comprising a generally tubular housing having a gas input opening and a high voltage power input terminal magnet means mounted on said housing providing a magnetic field therewithin anode means mounted within said housing in said magnetic field cathode means mounted within said housing between said anode means and said magnet means for collecting ions impinging thereon, and high voltage power supply means having a surrounding mounting sleeve, a low voltage input terminal and a high voltage output terminal, said power supply means mounting sleeve being mounted on said housing surrounding said output terminal and having its output terminal connected directly to the high voltage input terminal of said ion pump.

11. An ion pump including a generally tubular housing having a central axis with a gas input opening at one end and an axially extending high voltage power input terminal at its opposite end magnet means including a pair of opposed removable magnet yokes each extending around about one half the periphery of said housing to together surround said housing, and a pair of opposed magnets each removably retained between one of said yokes and the exterior surface of said housing providing a magnetic field therebetween high voltage conductor means having a surrounding insulating sleeve sealingly mounted at the input terminal end of said housing by a mounting cup mounted within in said housing anode means mounted on the end of said conductor means spaced from said insulating sleeve and between said magnets reactive metal cathode means mounted within said housing between said anode means and said magnets for reacting with gaseous ions impinging thereon to collect said ions cathode mounting means within said housing removably mounting said cathode means for removal and replacement thereof through said opening, and sputter shielding means closely spaced from and extending outwardly from the end of said insulating sleeve adjacent said anode means and cathode means for preventing deposition of sputter products on the outer peripheral surface of said insulating sleeve.

12. An ion pump as claimed in claims 8, 9 or 11, wherein said insulating sleeve includes a surrounding protuberance spaced from said sputter shielding means, and said mounting cup is closely spaced outwardly of said protuberance for preventing deposition of sputter products on a portion of said insulating sleeve.

13. An ion pump as claimed in claim 11, wherein said cathode mounting means includes spring clip means mounted in said housing with its free end generally parallel to the inner surface of said housing, and said cathode means comprises a "U" shaped sheet metal member having a base portion and leg portions with said base portion frictionally retained between said spring clip and the inner surface of said housing and its leg portions located between each of said magnets and said anode.

14. An ion pump as claimed in claim 11, wherein said magnet yokes overlap at their opposite ends to provide a closed magnetic loop, and said housing and each of said magnet yokes include opposed recesses for retaining said magnets.

15. An ion pump as claimed in claims 9 or 16, further including high voltage power supply means having a low voltage input terminal on one end and a high voltage output terminal on its opposite end, said power supply means being mounted on the power input terminal end of said housing and having its high voltage output terminal connected directly to the high voltage input terminal of said ion pump.

16. An ion pump as claimed in claim 15, further including current metering means having a low voltage input terminal and a low voltage output terminal with an ammeter connected therebetween, said current metering means being mounted on the low voltage input terminal end of said power supply means with its low voltage output terminals connected directly to the low voltage input terminals of said power supply.

17. An ion pump as claimed in claim 16 wherein said current metering means comprises an ammeter.

18. An ion pump including a generally tubular housing magnet means including magnet yoke means extending around at least about one half the periphery of said housing, and a pair of opposed magnets each retained between said yoke means and the exterior surface of said housing providing a magnetic field therewithin anode means mounted within said housing between said magnets, and cathode means mounted within said housing between said anode means and said magnet for collecting ions impinging thereon.

19. In an ion pump including a pump housing magnet means providing a magnetic field within said housing anode means positioned in said housing and in said field, and cathode means positioned between said anode means and said magnet means for collecting ions impinging thereon that improvement comprising cathode mounting means removably, frictionally and independently mounting said cathode means for removal and replacement thereof said cathode mounting means including spring clip means for mounting said cathode means, and wherein said cathode means comprises a "U" shaped sheet metal member having a base portion and leg portions, said base portion being frictionally retained by said spring clip means.

20. An ion pump including a generally tubular pump housing having an opening magnet means mounted on said housing providing a magnetic field therewithin anode means mounted within said housing in said magnetic field cathode means mounted within said housing between said anode means and said magnet means for collecting ions impinging thereon and cathode mounting means within said housing removably, frictionally and independently mounting said cathode means for removal and replacement thereof through said opening said cathode mounting means including spring clip means mounted in said housing with its free end generally parallel to the inner surface of said housing for frictionally mounting said cathode means, and wherein said cathode means comprises a "U" shaped sheet metal member having a base portion and leg portions with said base portion being frictionally retained between said spring clip and the inner surface of said housing.

21. An ion pump including a generally tubular pump housing magnet means including a pair of opposed magnet yokes each extending around about one half the periphery of said housing to together surround said housing, and a pair of opposed magnets each retained between one of said yokes and the exterior surface of said housing providing a magnetic field therewithin anode means mounted within said housing between said magnet means, and cathode means mounted within said housing between said anode means and said magnet means for collecting ions impinging thereon.

22. In an ion pump system including an ion pump comprising a generally tubular housing having a gas input opening and a high voltage power input terminal magnet means mounted on said housing providing a magnetic field therewithin anode means mounted within said housing in said magnetic field and being in electrical communication with said high voltage power input terminal cathode means mounted within said housing between said anode means and said magnet means for collecting ions impinging thereon, and high voltage power supply means in electrical communication with said ion pump and feeding a high voltage to said high voltage power input terminal thereof that improvement, wherein said high voltage power supply means comprises a low voltage input terminal, circuitry to convert low voltage received by said low voltage input terminal to a high voltage output, a high voltage output terminal to receive said high voltage output of said circuitry and a surrounding mounting sleeve, said mounting sleeve surrounding said high voltage output terminal and said mounting sleeve being of a size and shape and said high voltage output terminal being positioned relative to said sleeve such that said sleeve is detachably mountable to the tubular housing of said ion pump while placing the high voltage output terminal of said power supply means into direct mechanical and electrical communication with the high voltage power input terminal of said ion pump.

23. An ion pump as claimed in claims 1, 4 or 19, wherein, said cathode mounting means includes spring clip means mounted in said housing with its free end generally parallel to the inner surface of said housing for frictionally mounting said cathode means.

24. An ion pump as claimed in claims 5 or 9, wherein said magnet means includes a pair of opposed removable magnet yokes each extending around about one half the periphery of said housing to together surround said housing, and a pair of opposed magnets each removably retained between one of said yokes and the exterior surface of said housing providing a magnetic field therebetween.

25. An ion pump as claimed in claims 6 or 7, wherein said housing and each of said magnet yokes include opposed recesses for retaining said magnets.

26. An ion pump as claimed in any of claims 6, 7, 11, 14 or 21 wherein said magnet yokes are detachably secured to the exterior of said housing by means of a securing wire reeved therearound.

27. An ion pump as claimed in claims 6, 11, or 21, wherein said magnet yokes provide a closed magnetic loop around said housing.

28. An ion pump system as claimed in claims 10 or 22, further including low voltage current metering means for receiving and metering low voltage current received by said low voltage input terminal.

29. An ion pump as claimed in any of claims 1, 2, 3, 4, 5, 6, 8, 9, 10, 11, 18, 19, 20, 21 or 22 wherein said cathode means is composed of titanium.

* * * * *